United States Patent [19]

Okayasu

[11] Patent Number: 5,001,848

[45] Date of Patent: Mar. 26, 1991

[54] SHOE INSOLE

[75] Inventor: Kenji Okayasu, Gyoda, Japan

[73] Assignee: Rikio Co., Ltd., Gyoda, Japan

[21] Appl. No.: 462,990

[22] Filed: Jan. 10, 1990

Related U.S. Application Data

[63] Continuation of Ser. No. 176,334, Mar. 31, 1988, abandoned.

[51] Int. Cl.[5] ..... A43B 13/38; A43B 13/00

[52] U.S. Cl. ..... 36/107; 36/44; 36/76 C

[58] Field of Search ..... 36/107, 108, 44, 76 C, 36/85, 97, 132; 148/403; 428/658

[56] References Cited

U.S. PATENT DOCUMENTS

| | | | |
|---|---|---|---|
| 199,842 | 1/1878 | Mattocks | 36/44 |
| 1,637,565 | 8/1927 | Gordon | 36/132 |
| 1,652,307 | 12/1927 | Hines | 36/44 |
| 1,676,162 | 7/1928 | Schiller | 36/44 |
| 1,685,538 | 9/1928 | Glidden et al. | 36/44 |
| 1,975,972 | 10/1934 | Peschke | 36/44 |
| 2,641,068 | 6/1953 | Thompson | 36/44 |
| 2,736,109 | 2/1956 | Scholl | 36/44 |
| 4,026,045 | 5/1977 | Druss | 36/108 |
| 4,050,931 | 9/1977 | Tanner et al. | 148/403 |
| 4,053,332 | 10/1977 | Egami et al. | 148/403 |
| 4,709,921 | 12/1987 | Valvikas et al. | 36/132 |
| 4,715,131 | 12/1987 | Kremendahl | 36/44 |

FOREIGN PATENT DOCUMENTS

| | | | |
|---|---|---|---|
| 3536728 | 4/1984 | Fed. Rep. of Germany | 428/658 |
| 705294 | 3/1931 | France | 36/44 |

*Primary Examiner*—Steven N. Meyers

*Attorney, Agent, or Firm*—Fleit, Jacobson, Cohn, Price, Holman & Stern

[57] ABSTRACT

Herein disclosed is an insole for use in a shoe, which comprises: a metallic core having at least its portion made of an amorphous metal sheet and shaped to match the sole of the shoe for preventing the shoe from being pricked; and a sheath enveloping the metallic core. The insole thus manufactured can enjoy the high prick-prevention and flexibility. When used in a shoe, the insole allows the shoe to bend well without any deterioration of the springy step. The insole is advantageous in its economy because it can prevent the shoe from being pricked, if used.

3 Claims, 2 Drawing Sheets

SHOE INSOLE

This application is a continuation of application Ser. No. 07/176,334, filed Mar. 31, 1988 now abandoned.

BACKGROUND OF THE INVENTION

1. Field of the Invention

The present invention relates to a working shoe such as a workman's split-toed heavy-cloth shoe and, more particularly, to an insole to be used in the shoe.

2. Description of the Prior Art

In the working shoe of the prior art, a core of a metal sheet of steel, stainless steel or the like is attached to the sole of the shoe so that the shoe may be prevented from being pricked by a nail or the like.

In order to increase a resistance to the prick thereby to enhance the safety, it is necessary to increase the thickness of the core of the metal sheet. This increase in turn makes it difficult to bend the shoe thereby to seriously deteriorate the springy step accompanied by the bending motions.

Taking both of these merits and demerits into consideration, there is proposed a workman's split-toed heavy-cloth shoe which incorporates therein a stainless steel sheet having a thickness of about 0.3 mm. This shoe thus proposed is a compromise between the safety and the springy step accompanied by the bending motions so that it has neither the prick-prevention as high as that of the safety shoe conforming to the Japanese Industrial Standards nor a bendability as high as that of the existing split-toed heavy-cloth shoe.

SUMMARY OF THE INVENTION

The present invention contemplates to eliminate the drawbacks specified above and has an object to provide an insole which is intended to prevent the shoe from being pricked, while deteriorating none of the springy step accompanied by the bending motions, by making it of an amorphous metal sheet.

The gist of the present invention resides in an insole which is characterized: in that a metallic core sized to match the sole of a shoe for preventing the prick has at least its portion made of an amorphous metal sheet and is enveloped in a sheath.

According to the present invention, there is provided an insole for use in a shoe, comprising: a metallic core having at least its portion made of an amorphous metal sheet and shaped to match the sole of said shoe for preventing said shoe from being pricked; and a sheath enveloping said metallic core.

The insole of the present invention finds its especial application to a working shoe such as the workman's split-toed heavy-cloth shoe or the safety shoe, which is required to prevent the prick but not to deteriorate the springy step accompanied by the bending motions. If, however, a steel sheet is fitted in the sole of the shoe, the aforementioned defect is invited to deteriorate the springy work. The shoe of this kind is used in a variety of working fields, some of which do not have any fear of the prick. This shoe could be conveniently used in the fields, if satisfied the different modes of use.

In view of this background, the present invention contemplates to provide an excellent insole which can be used for preventing the prick, if necessary, and which is enabled not to deteriorate the springy step of the shoe, if used, by having at least a portion of a prick-preventing metallic core made of an amorphous metal sheet. Generally speaking, an amorphous metal is more expensive than other metals. Therefore, the insole of the present invention affords an advantage because it need not be scrapped but can be reused economically even if the shoe as a whole has to be scrapped when another shoe part is damaged.

BRIEF DESCRIPTION OF THE DRAWINGS

Other objects, features and advantages of the present invention will become apparent from the following description in connection with the embodiments thereof with reference to the accompanying drawings, in which.

DESCRIPTION OF THE PREFERRED EMBODIMENTS

Figure 1:
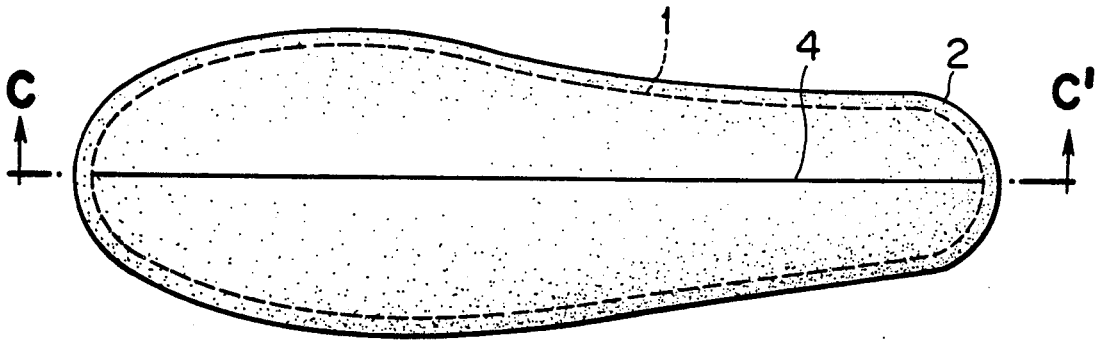
FIG. 1 is a bottom plan view showing an insole according to a first embodiment of the present invention.

A first embodiment will be described in the following with reference to FIGS. 1 to 3. Reference numeral 1 designates a metallic core shaped to match the sole of a shoe, and numeral 2 designates a sheath enveloping the metallic core 1. In this embodiment, the core 1 in its entirety is made of an amorphous metal sheet A which is composed of a plurality of amorphous metal foils Al, as seen from FIG. 3.

Generally speaking, an amorphous metal has a far higher tensile strength per unit sectional area than that of a metal belonging to an identical group having an ordinary crystal structure. In the case of an iron alloy, for example, the tensile strength of ordinary stainless steel is about 50 $kgf/mm^2$, whereas the tensile strength of the amorphous metal of an iron-chromium-manganese alloy is so high as 330 $kgf/mm^2$ that it exhibits a high resistance to the prick. Moreover, the amorphous metal is formed without any difficulty into bendable foils so that it can suffice the object of the present invention.

Figure 2:
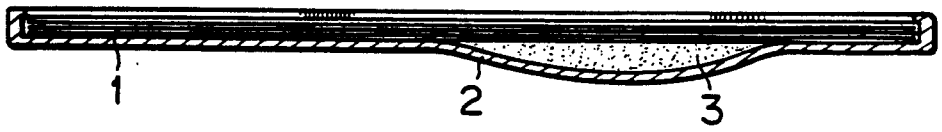
FIG. 2 is a section taken along the center line C—C' of FIG. 1.
Figure 3:
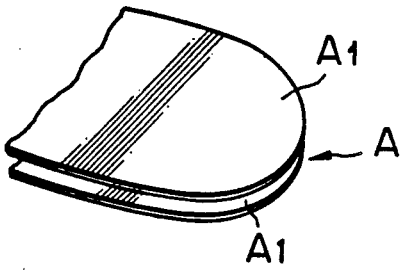
FIG. 3 is a perspective view showing a portion of an amorphous metal sheet.

Incidentally, in FIGS. 1 to 3, reference numeral 3 designates a cushioning material to fill, if necessary, and numeral 4 designates a slit formed in the sheath 2 for inserting or taking out the amorphous metal foils 1. Incidentally, this slit 4 to be used for replacing the sheath 2 may preferably be formed in the bottom side of the sheath 2.

The amorphous metal to be suitably used in the present invention should have a high tensile strength and is exemplified by an iron alloy of iron-chromium-manganese or iron-boron, a cobalt alloy of cobalt-zirconium or cobalt-silicon-boron, or a nickel alloy of nickel-zirconium, but should not be limited thereto. Since, on the other hand, one amorphous alloy foil have a thickness of about 20 to 30 microns, it is recommended to use two or more foils.

Incidentally, the sheath to be used in the present invention may be made of rubber, plastics, or their sponge, or a variety of fibers.

Figure 4:
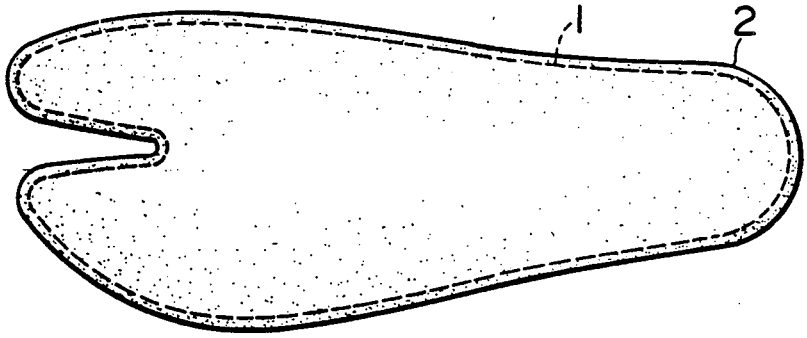
FIG. 4 is a bottom plan view showing an insole according to a second embodiment of the present invention.
Figure 5:
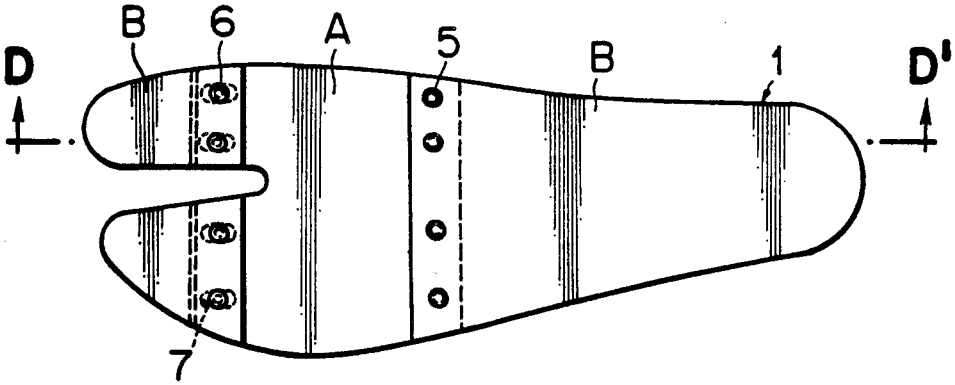
FIG. 5 is a bottom plan view showing a core used in the insole of FIG. 4.
Figure 6:
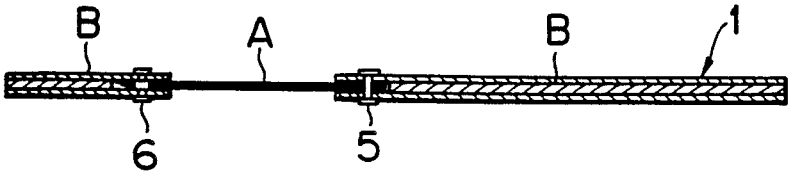
FIG. 6 is a section taken along line D—D' of FIG. 5.

Turning now to FIGS. 4 to 6 showing a second embodiment, reference numerals 1 and 2 also designate the metallic core and the sheath, respectively. Of these, the core 1 is constructed of the amorphous metal sheet A only at its bending portion and an ordinary metal sheet B at its other portions. In this embodiment, too, a similar amorphous metal is used but arranged only at the bending portion to improve the economy better.

The embodiment of FIG. 6 is manufactured by spot-welding or adhereing three metal sheets or members B, B1 and B2 the intermediate one B1 of which is shortened to receive the amorphous metal sheet. Numeral 5 designates fastenings for jointing the amorphous metal sheet A and the upper and lower metal sheets B and B2. The fastenings 5 are embodied here by rivets 6 but may be an adhesive of epoxy group.

Figure 7:
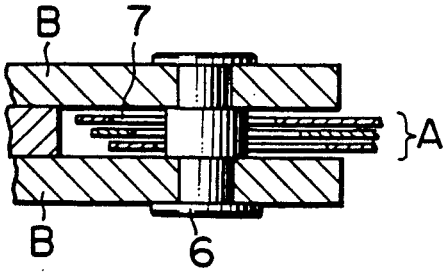
FIG. 7 is an enlarged section showing a fastened portion of the toe of the insole.

In case, on the other hand, a plurality of amorphous metal sheets are used in a superposed manner, they are displaced from one another at the bending portion. In order to release these displacements, the joint at the toe is accomplished by stepping the rivets and by forming the amorphous metal sheets with slots 7 to leave gaps, as shown in FIG. 7, so that the amorphous metal sheets A may move freely between the metal sheets B and B2.

Although the embodiment of FIG. 6 has been described in the case of the workman's split-toed heavy-cloth shoe, the present invention should not be limited thereto but can be applied to an ordinary shoe.

With the structure thus far described, the insole of the present invention can enjoy the high prick-prevention and flexibility. When used in a shoe, the insole allows the shoe to bend well without any deterioration of the springy step. The insole is advantageous in its economy because it can prevent the shoe from being pricked, if used.

What is claimed is:

1. An insole for use in a shoe, said insole comprising:

a metallic core made of a plurality of amorphous metal foils shaped at least in part to match the sole of said shoe for preventing said shoe from being pricked, a sheath enveloping said metallic core, said amorphous metal foils being superposed in slidable engagement with each other and being freely movable with respect to each other, and a laminate composed of three metal members adhered to one another, an intermediate one of said three metal members being shortened to sandwich said metallic core between a remaining upper metal member and a remaining lower metal member of said three metal members.

2. An insole according to claim 1, wherein said metallic core is bendable at a bending portion of the shoe.

3. An insole according to claim 1, wherein said amorphous metal foils have slots for receipt of rivets so that they move freely without their mutual interference.

* * * * *